US005494095A

United States Patent [19]

Blazek et al.

[11] Patent Number: 5,494,095

[45] **Date of Patent: *Feb. 27, 1996**

[54] APPARATUS FOR CONTINUOUS CASTING OF MOLTEN STEEL

[75] Inventors: Kenneth E. Blazek, Crown Point; Ismael G. Saucedo, Valparaiso; James E. Kelly, Griffith, all of Ind.

[73] Assignee: Inland Steel Company, Chicago, Ill.

[ * ] Notice: The term of this patent shall not extend beyond the expiration date of Pat. No. 5,379,828.

[21] Appl. No.: 351,812

[22] Filed: Dec. 8, 1994

Related U.S. Application Data

[63] Continuation of Ser. No. 172,863, Dec. 27, 1993, Pat. No. 5,379,828, which is a continuation of Ser. No. 928,848, Aug. 11, 1992, abandoned, which is a continuation-in-part of Ser. No. 865,710, Apr. 8, 1992, Pat. No. 5,178,204.

[51] Int. Cl.[6] ..... B22D 11/04; B22D 11/06; B22D 11/07; B22D 27/02

[52] U.S. Cl. ..... 164/418; 164/428; 164/504

[58] Field of Search ..... 164/418, 459, 164/504, 468, 428, 429, 479, 480

[56] References Cited

U.S. PATENT DOCUMENTS

| | | | |
|---|---|---|---|
| 3,667,534 | 6/1972 | Kanokogi et al. | 164/418 |
| 4,139,048 | 2/1979 | Andersson | 164/504 |
| 4,450,892 | 5/1984 | Heinemann et al. | 164/467 |
| 4,465,118 | 8/1984 | Dantzig et al. | 164/467 |
| 4,515,204 | 5/1985 | Ohno | 164/483 |
| 4,936,374 | 6/1990 | Pareg | 164/503 |
| 4,974,661 | 12/1990 | Lari et al. | 164/503 |
| 5,020,585 | 6/1991 | Blazek et al. | 164/452 |
| 5,197,535 | 3/1993 | Mulcahy | 164/468 |
| 5,379,828 | 1/1995 | Blazek et al. | 164/459 |

FOREIGN PATENT DOCUMENTS

| | | |
|---|---|---|
| 170923 | 4/1952 | Austria . |
| 52-42130 | 10/1977 | Japan . |
| 55-128349 | 10/1980 | Japan . |
| 60-49834 | 3/1985 | Japan . |

OTHER PUBLICATIONS

Hamer, R. D., "Hazelett and Rotary Strip–Casting Machines . . . ", The Journal Of The Institute of Metals, vol. 87, 1959, pp. 219–226.

Article entitled "Krupp Reportedly Has Thin–Strip," in Metal Producing, vol. 33, p. 10, Apr. 1992.

Yoshida, C., et al., "Microstructure of Rapidly Solidified High Speed and Carbon Tool Steels", Transactions I.S.I.J., vol. 27, No. 10, 1987, pp. 819–822.

Ferretti, A., et al., "CSM's Research Activity on Thin Slab Casting", I&SM, vol. 18, Nov. 1987, p. 17.

Nishioka, S., et al., "Study of the Twin–Roller Process for Manufacturing Thin Cast Strips", contained in a Japanese publication dated Aug. 1985 (translation provided).

Tarmann, B., et al., "Operating Experiences With Thin–Walled, Seamless Moulds for Continuous Casting", Stahl und Eisen, vol. 81, No. 2, Jan., 1961, pp. 111–119 (translation provided).

Tarmann, B., et al., "Service Performance of Continuous Casting Molds Made of Difference Materials", Radex Rundeschau, No. 5, 1964, pp. 290–298.

*Primary Examiner*—Kuang Y. Lin
*Attorney, Agent, or Firm*—Marshall, O'Toole, Gerstein, Murray & Borun

[57] ABSTRACT

A non-magnetic material having a relatively high electrical resistance, such as austenitic stainless steel, is used for the material of construction of the mold utilized in a conventional continuous casting apparatus, or in a rheocasting apparatus or in a continuous strip casting apparatus.

4 Claims, 3 Drawing Sheets

APPARATUS FOR CONTINUOUS CASTING OF MOLTEN STEEL

CROSS REFERENCE TO RELATED APPLICATIONS

This is a continuation of Blazek, et al. U.S. Ser. No. 08/172,863, filed Dec. 27, 1993, now U.S. Pat. No. 5,379,828, in turn a continuation of U.S. Ser. No. 07/928,848 filed Aug. 11, 1992, now abandoned, which is a continuation-in-part of Kelly, et al. U.S. Ser. No. 07/865,710, filed Apr. 8, 1992, now U.S. Pat. No. 5,178,204, and the disclosures thereof are hereby incorporated herein by reference.

BACKGROUND OF THE INVENTION

The present invention relates generally to an apparatus and method for the continuous casting of molten steel, and more particularly to the mold which is employed therein.

Continuous casting molds for molten steel are conventionally composed of copper or an alloy of copper. In conventional continuous casting, the mold has open upstream and downstream ends and side walls. Molten steel is introduced into the upstream end of the mold for flow in a downstream direction. The mold side walls contain the molten steel against flow in a direction transverse to the downstream direction.

The mold contains channels through which a cooling fluid is circulated. The cooling fluid carries away from the mold heat which is absorbed from the molten steel introduced into the interior of the mold, causing the molten steel to solidify as it moves in a downstream direction through the mold. Initially, a thin shell of solidified steel is formed adjacent the interior surface of the mold, and as the molten steel moves in a downstream direction through the mold, the shell of solidified steel thickens.

In another type of continuous casting, known as rheocasting or slurry casting, the mold is located downstream of a mixing chamber which receives molten steel and subjects the molten steel to vigorous stirring to break up solidifying dendrites which can form as the molten steel moves through the mixing chamber. A dendrite is a solidified particle shaped like an elongated stem having transverse branches extending therefrom. Breaking up the dendrites produces a material, for introduction into the casting mold, consisting primarily of molten steel together with a minor portion of fragmented and/or degenerate dendritic particles. A degenerate dendrite is a fragmented (broken up) dendrite having rounded off ends. Examples of rheocasting methods and apparatuses are described in the aforementioned Kelly, et al. U.S. Pat. No. 5,178,204.

Another type of continuous casting, known as continuous strip casting, employs a pair of opposed, counter-rotating, cooled rolls, in the case of double substrate continuous strip casting. The two counter-rotating rolls define the mold. There are a pair of side openings each at a respective opposite end of the pair of rolls. A containment dam is located at each side opening to prevent molten steel introduced between the rolls from flowing outwardly through the side opening. The molten steel is cooled as it descends downstream between the rolls, and a continuous strip of solidified steel exits the mold at the nip of the rolls, moving in a downstream direction.

In another form of continuous strip casting, called single substrate casting, a single roll rotates upwardly adjacent an open side of a tundish containing molten metal, and a strip solidifies on the periphery of the rotating roll. Containment dams are located at least on opposite sides of the roll at the junction of the roll and the ends of the adjacent side walls of the tundish.

In the case of a conventional continuous caster, it has been desirable to employ, in association with the casting mold, a system for magnetically stirring the molten steel within the casting mold; in the case of a rheocasting apparatus, such a system is essential. Typically, a current-conducting coil is located around the exterior of the casting mold, and a time-variable electric current is flowed through the coil which causes the coil to generate a magnetic field which is directed into the molten steel within the mold. This creates flow conditions within the molten steel in the mold which causes the molten steel to undergo stirring.

Either copper or an alloy of copper has been conventionally employed as the material of which a continuous casting mold is composed because copper has relatively high thermal conductivity which promotes rapid solidification of the steel. This increases the rate at which the steel can be continuously cast, and that is desirable. As used herein, the term "copper alloy" refers to those copper alloys heretofore conventionally used as the material for molds employed in the various types of continuous casting.

There is a drawback arising from the use of copper or copper alloy as the material of which the mold is composed. Because of its electrical conductivity (low electrical resistance), copper is relatively difficult for a magnetic field to penetrate. A substantial portion of the strength of the magnetic field (e.g. 50%) is attenuated due to the high electrical conductivity (low resistance) of copper or copper alloy.

It would be desirable to provide a continuous casting mold composed of a material which could remove heat from the molten steel contained within the mold at a rate approaching that of copper while avoiding the attenuating effect which copper has on a magnetic field.

In an apparatus for continuous strip casting, the rotating rolls are conventionally composed of copper, and in many embodiments of double substrate casting, magnetic containment dams are employed to generate a magnetic field extending across the side opening between counter-rotating rolls, to prevent the molten steel from flowing outwardly through the side opening. Examples of a double substrate continuous strip casting apparatus employing magnetic containment dams are disclosed in Praeg U.S. Pat. No. 4,936,374, in Lari, et al. U.S. Pat. No. 4,974,661 and in Gerber, et al. U.S. application Ser. No. 07/902,559, filed Jun. 22, 1992, In single substrate continuous strip casting, a magnetic containment dam, at the junction of the roll and the adjacent ends of the side walls of the tundish, prevents molten metal from flowing out of the tundish at that junction.

In continuous strip casting apparatuses, the copper, of which the rotating rolls are composed, has an attenuating effect on the strength of the magnetic field generated by the magnetic containment dam. As with molds employed in conventional continuous casting or in continuous rheocasting, it would be desirable to provide a mold for continuous strip casting which could extract heat from the molten steel at a rate approaching that of copper and which avoids the attenuation that copper has on the strength of the magnetic field.

SUMMARY OF THE INVENTION

In accordance with the present invention there is provided a continuous casting apparatus having a mold composed of a non-magnetic material which enables the mold to extract heat from molten steel contained within the mold at a rate approaching that of copper while minimizing the attenuation of the strength of a magnetic field generated by a magnetic stirring device or by a magnetic containment dam associated with the mold. Preferably, the mold is composed of austenitic stainless steel.

In the case of a rheocasting apparatus or a conventional continuous caster, the casting mold is composed of the non-magnetic material, and the mold has an interior surface unlined by refractory and composed of the aforementioned mold material. In the case of continuous strip casters, the rotating rolls are composed of the non-magnetic material.

In the case of casting molds for the conventional, continuous caster or the rheocasting apparatus, additional advantages arise from making the mold out of a non-magnetic material. A magnetic stirrer used in association with the mold can be operated at a frequency substantially higher than the frequency which could be employed if the mold were composed of copper. For example, the magnetic stirrer can be operated at a frequency in the range of 40–600 Hertz (e.g. 400–600 Hertz), compared to a frequency in the range 4 to 20 Hertz for a mold composed of copper or copper alloy. The higher the frequency, the greater the intensity of stirring. Other advantages arising from a mold composed of a non-magnetic material, such as austenitic stainless steel or its equivalents, include reduced friction in the mold, improved surface quality on the casting emanating from the mold, and the ability advantageously to utilize powdered mold lubricants which liquify or recrystallize at substantially higher temperatures than those which could be employed with a mold composed of copper.

Other features and advantages are inherent in the apparatus and method claimed and disclosed or will become apparent to those skilled in the art from the following detailed description in conjunction with the accompanying diagrammatic drawings.

DETAILED DESCRIPTION

The present invention utilizes a non-magnetic material, such as austenitic stainless steel or its equivalent, as the material from which continuous casting molds are composed, whether the mold be employed in a conventional continuous casting apparatus, in a rheocasting apparatus or in the form of one or two rotating rolls in a continuous strip casting apparatus. Although the thermal conductivity of this material is substantially less than that of copper or copper alloy, e.g. less than 5% of copper's conductivity in the case of austenitic stainless steel, the heat extraction rate of a mold composed of such a material approaches that of a copper mold because of another phenomenon.

The rate at which heat is extracted from molten metal within a casting mold (the mold heat transfer rate or MHTR) is proportional not only to the thermal conductivity of the material of which the mold is composed, but also to the temperature gradient or temperature profile between the hot, interior surface of the mold and the temperature of the mold at the cooling channel through which cooling fluid is circulated in the mold wall. In a mold composed of austenitic stainless steel or the like, the temperature at the hot, interior mold surface is substantially higher than it would be if the mold were composed of copper, because of the lower thermal conductivity of the stainless steel. In both cases, the temperature at the cooling channel would be substantially the same. Assuming that the distance between the hot surface and the cooling channel is the same in both cases, the temperature gradient for a mold composed of austenitic stainless steel or the like is greater than the temperature gradient for a mold composed of copper. The greater temperature gradient for a mold composed of austenitic stainless steel or the like, substantially, if not totally, offsets the lower thermal conductivity thereof in providing a mold heat transfer rate comparable to that of a copper mold.

Figure 7:
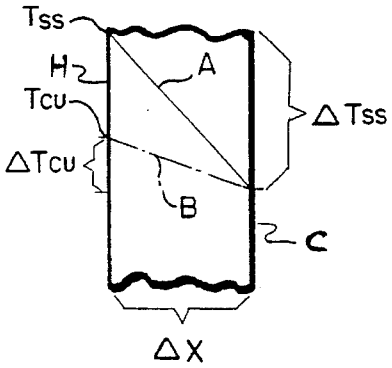
FIG. 7 is a diagram illustrating, in graph form, the temperature gradient between the hot interior surface and the cooling channel of a continuous casting mold wall.

FIG. 7 illustrates, in graph form, the respective temperature gradients for a mold composed of austenitic stainless steel (or an equivalent material), at line A, and for a mold composed of copper or an alloy of copper, at line B. H represents the interior or hot surface of the mold wall; C represents a cooling channel surface (the cold surface) in the mold wall. $\Delta X$ is the distance between H and C, through the mold wall. $T_{ss}$ is the temperature of the interior wall surface H, when the mold wall is composed of austenitic stainless steel or the like; $T_{cu}$ is the corresponding temperature at the same location on wall surface H when the mold wall is composed of copper or the like. $T_c$ is the temperature at the cooling channel or cold mold surface. $\neq T_{ss}$ is the temperature differential between the hot and cold mold surfaces (H and C) when the mold wall is composed of austenitic stainless steel or the like; $\Delta T_{cu}$ is the corresponding temperature differential when the mold wall is composed of copper or the like.

Because copper has a higher thermal conductivity than austenitic stainless steel, $T_{cu}$ is substantially less than $T_{ss}$. However, because $T_{ss}$ is greater than $T_{cu}$, the temperature gradient for a mold wall composed of austenitic stainless steel, $\Delta T_{ss}/\Delta X$ (line A), is greater (steeper) than the temperature gradient for a mold wall composed of copper, $\Delta T_{cu}/\Delta X$ (line B). The rate of heat extraction provided by the mold (the mold heat transfer rate or MHTR) is proportional not only to thermal conductivity but also to thermal gradient ($\Delta AT/\Delta X$), as specified in the equation $MHTR=-k(\Delta T/\Delta AX)$, where k is the thermal conductivity of the mold material. As a result, the decreased thermal conductivity available with a stainless steel mold wall (compared to a copper mold wall) is substantially, if not totally, offset by the increased temperature gradient available with a stainless steel mold wall, compared to a copper mold wall.

Moreover, when the mold is composed of stainless steel, the mold wall thickness between H and C, ($\Delta X$), can be reduced compared to the mold wall thickness required when the mold is composed of copper; this is because stainless steel has greater heat resistant properties (e.g. resistance to thermal stress) than copper. For example, in a conventional continuous caster the distance between the hot mold interior surface H and cooling surface C, ($\Delta X$), is typically in the range 0.25 to 1 in. (0.64 to 2.54 cm) for a copper casting mold, but when the mold is composed of stainless steel, the mold wall thickness ($\Delta X$) can be reduced, e.g., to a thickness in the range 0.125 to 0.5 in. (0.32 to 1.27 cm. A reduction in mold wall thickness, ($\Delta X$), allows one to obtain a change in the temperature of the mold wall interior surface H. In both the copper and stainless steel molds described in the preceding sentence, the cooling channel has a width typically of about 0.25 in. (0.64 cm).

Unless otherwise indicated, the following exemplary discussion relates to a conventional continuous caster for steel as distinguished from a rheocaster or a continuous strip caster. The respective mold heat transfer rates one can obtain when employing a copper continuous casting mold and an austenitic stainless steel continuous casting mold are discussed below.

The information discussed in this paragraph refers to conventional continuous casting employing a liquid mold lubricant. At a casting speed of 0.6 m/min., for all steels cast in a stainless steel mold, the MHTR is approximately the same as for a peritectic steel (0.10 wt. % carbon) cast in a copper mold and about 90% of the MHTR for steels containing 0.05 wt. %, 0.25 wt. % and 0.50 wt. % carbon cast in a copper mold. At a casting speed of 1.2 m/min., for all steels cast in a stainless steel mold, the MHTR is about 90% of the MHTR for a peritectic steel cast in a copper mold and about 70% of the MHTR for all the other above-described steels cast in a copper mold.

When a powdered mold lubricant is employed in conventional continuous casting, the MHTR for all steels cast in a stainless steel mold will be approximately 90% of the MHTR for steels cast in a copper mold.

The casting speed employed in continuous casting depends upon the thickness of the cast steel shell upon exit thereof from the casting mold. If the shell does not have the desired thickness, the casting speed must be adjusted to provide the desired shell thickness. This can be determined empirically. Generally, a casting speed in the range 0.2 to 1.8 m/min. should be useable in conventional continuous casting or rheocasting for virtually all carbon contents of molten steel cast in a stainless steel mold in accordance with the present invention.

A numerical comparison of the relative interior surface temperatures for a stainless steel mold and a copper mold is described below in this paragraph. A steel containing 0.25 wt. % carbon was continuously cast at a casting rate of 1.1 m/min. in a mold that was about 46 cm long from upstream end to downstream end and had a square interior cross-section of 8.3 cm on each side. The mold lubricant was oil. The top surface of the molten steel was about 6.2 cm below the top of the mold. Temperatures were measured to a distance of about 40 cm from the top of the mold. The highest temperature measured was about 10 cm from the top of the mold. For the stainless steel mold, the highest temperature measured was about 350° C. For the copper mold, the temperature at the corresponding location was about 190° C. The temperatures in the stainless steel mold were approximately 160° C. higher than in the copper mold at substantially all locations in the mold.

Figure 1:
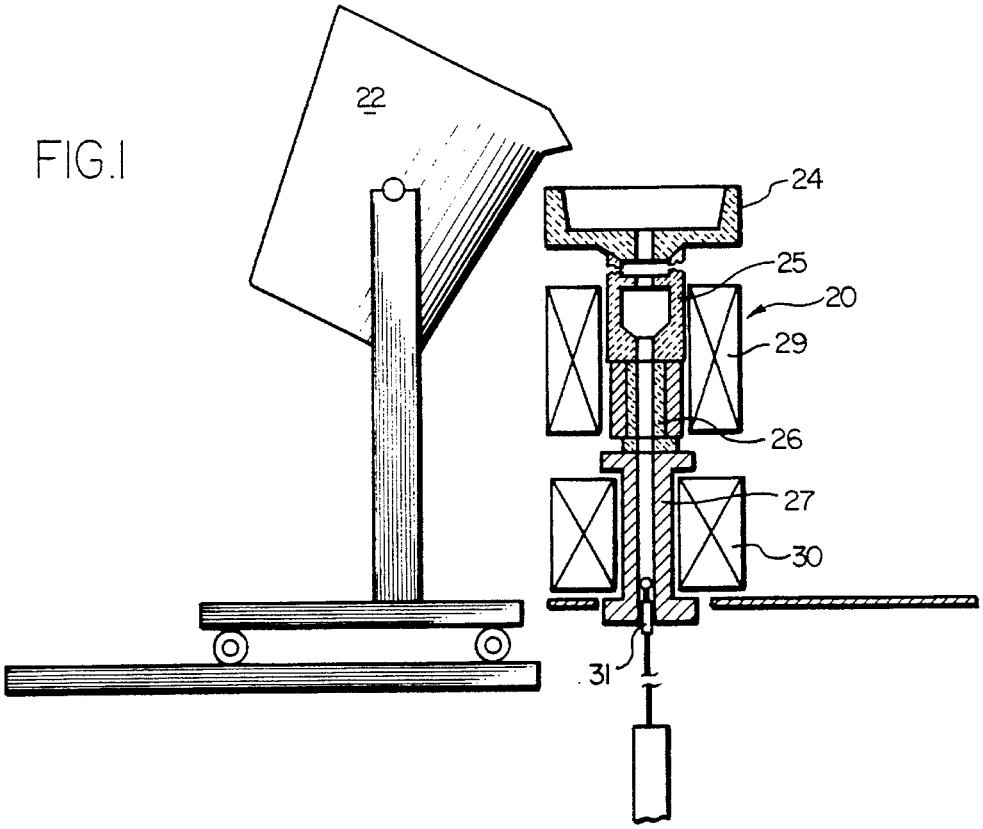
FIG. 1 is an elevational view, partially in section, illustrating rheocasting apparatus including a casting mold.

Referring now to FIG. 1, indicated generally at 20 is a rheocasting apparatus employed in association with a ladle 22 from which molten steel is poured into a tundish 24 communicating with the upstream end of a mixing chamber 25 lined with refractory. Communicating with the downstream end of mixing chamber 25 is a conduit 26 which in turn communicates with the upstream end of a casting mold 27. A magnetic stirrer 29 is located around mixing chamber 25 and conduit 26, and another magnetic stirrer 30 is located around casting mold 27.

Molten steel entering mixing chamber 25 undergoes stirring therein to break up dendrites which may form therein. A mixture consisting primarily of molten steel with a minor portion of fragmented and/or degenerate dendritic particles descends from stirring chamber 25 through conduit 26 into casting mold 27 where the molten steel is solidified, initially to form a shell of solid steel around an interior of mostly molten or partially solidified steel. A dummy bar arrangement 31 located at the bottom of casting mold 27 initially supports the solidified shell within casting mold 27. When the shell is sufficiently thick, at both the side walls and bottom of the shell, dummy bar 31 is withdrawn downwardly from the bottom portion of casting mold 27 and remains withdrawn during the rest of the rheocasting operation.

A more detailed description of a rheocasting apparatus and its operation is contained in the Kelly, et al. patent identified above.

Figure 2:
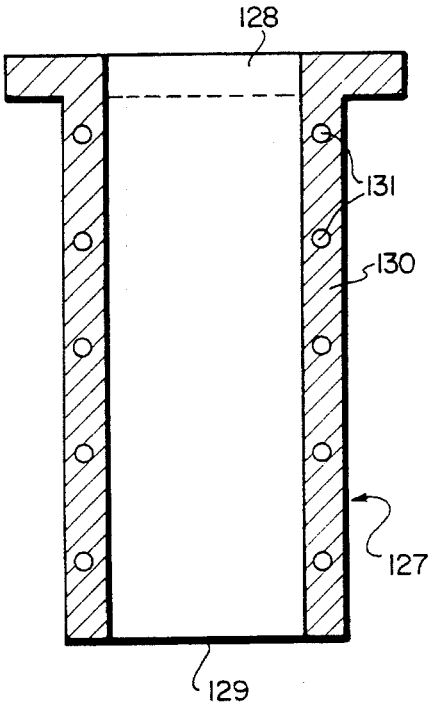
FIG. 2 is an enlarged vertical sectional view of a casting mold for a rheocasting apparatus.

Indicated generally at 127 in FIG. 2 is a casting mold for a rheocasting apparatus constructed in accordance with an embodiment of the present invention. Mold 127 includes an upstream end 128, a downstream end 129, and a side wall 130 for containing molten metal and preventing the molten metal from escaping in a direction transverse to a downstream direction (which is toward downstream end 129). Located within side wall 130 are a plurality of horizontally disposed, vertically spaced, cooling channels 131. A cooling fluid, such as water, is circulated through cooling channels 131 to carry away from mold side wall 130 the heat extracted by the side wall from the molten steel contained in 127. Mold 130 is composed of austenitic stainless steel or the like.

Figure 3:
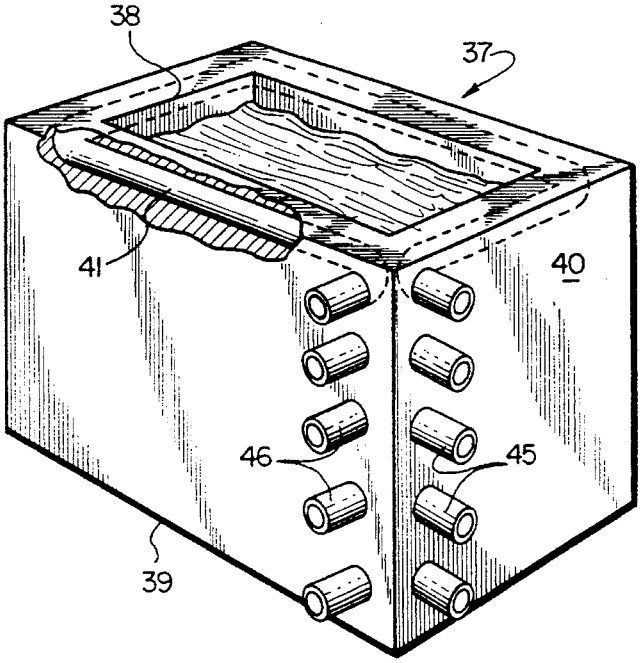
FIG. 3 is a perspective of a conventional continuous casting mold.
Figure 4:
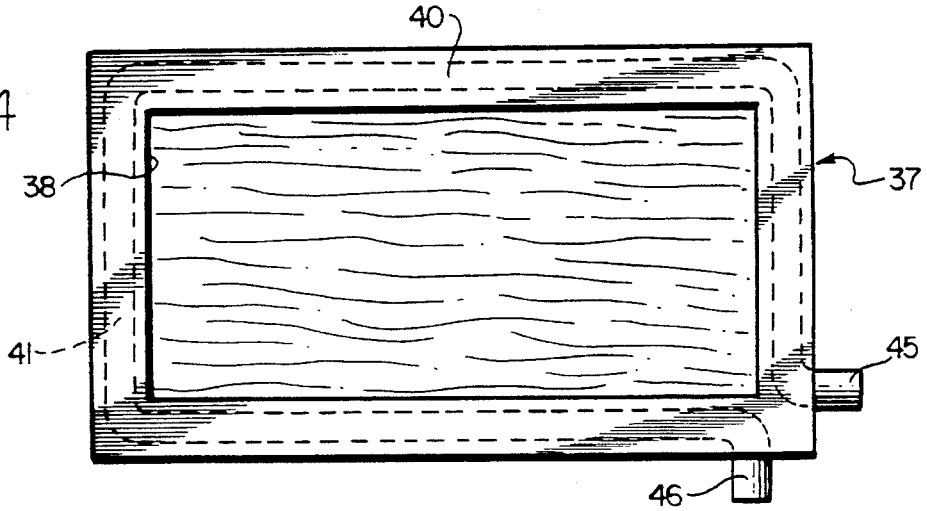
FIG. 4 ms a plan view of the continuous casting mold of FIG. 3.
Figure 9:
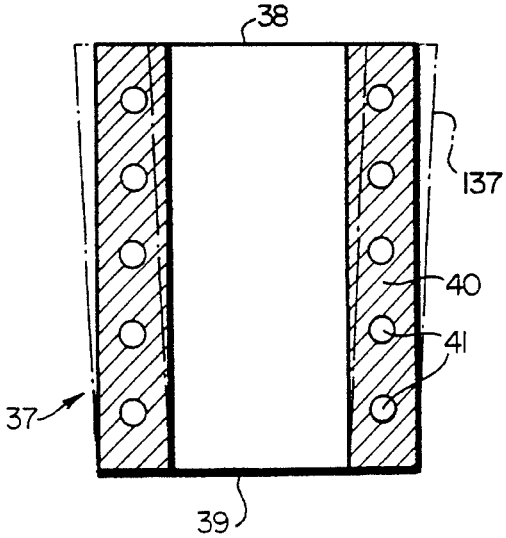
FIG. 9 is a vertical, sectional view of a conventional continuous casting mold having horizontal channels, and illustrating the use of downwardly tapered walls to compensate for contraction during solidification.

Referring now to FIGS. 3–4 and 9, indicated generally at 37 is a continuous casting mold constructed in accordance with an embodiment of the present invention. Mold 37 is part of what is otherwise a conventional continuous casting apparatus familiar to those skilled in the art of continuous casting. As used herein, the term "conventional continuous casting mold" refers to a mold used in a conventional continuous casting operation (as distinguished from a rheocasting operation or a continuous strip casting operation), although the mold itself may incorporate unconventional features.

Mold 37 has an open upstream end 38, an open downstream end 39 (FIG. 9), and a peripheral side wall 40. Located within side wall 40 are a plurality of horizontally disposed, vertically spaced cooling channels 41 which function in the same manner as cooling channels 131 in mold 127, as described above in connection with FIG. 2.

Casting mold 37 receives molten steel from a tundish such as 24 in FIG. 1 and incorporates a dummy bar at downstream end 39 at the beginning of the casting operation until the shell solidifying within the mold is sufficiently thick to permit the withdrawal of the dummy bar and the descent of the solidified shell in a downstream direction from the casting mold. A casting mold having horizontally disposed cooling channels is described in greater detail in Blazek, et al. U.S. Pat. No. 5,020,585 issued Jun. 4, 1991, and the disclosure thereof is incorporated herein by reference.

Figure 5:
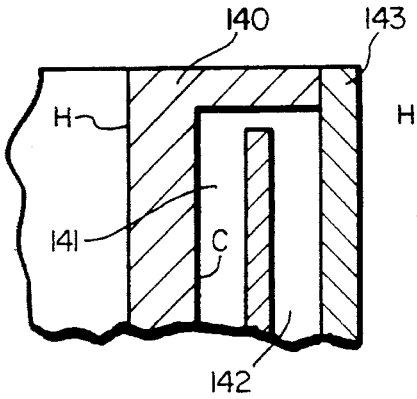
FIG. 5 is an enlarged, fragmentary, vertical sectional view of a portion of a conventional continuous casting mold wall having vertical cooling channels.
Figure 6:
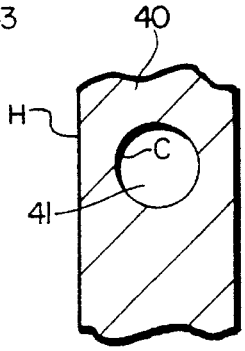
FIG. 6 is an enlarged, fragmentary, vertical sectional view of a portion of a continuous casting mold wall having horizontal cooling channels.

FIG. 6 illustrates a continuous casting mold side wall 40 having a horizontally disposed cooling channel 41; while FIG. 5 illustrates a continuous casting mold side wall 140 having a vertically disposed cooling channel 141. The interior surface of mold side wall 40 or 140 corresponds to the hot surface H shown in the diagram in FIG. 7 and is correspondingly marked H in FIGS. 5 and 6. Similarly, the cold surface C in FIG. 7 has its counterparts in cooling channel 41 in FIG. 6 and cooling channel 141 in FIG. 5, and those counterparts are marked C in FIGS. 5 and 6. In the mold of FIG. 5, cooling channel 141 communicates with a fluid circulating channel 142 enclosed by a mold wall back plate 143.

Referring again to FIG. 6, cooling channel 41 may have a circular shape, as shown, or it may have polygonal or other shapes. In other embodiments, the cooling channels, either horizontal or vertical, are defined by two members, the mold wall and a baffle plate attached to the exterior surface of the mold wall. In these embodiments, the exterior surface of the mold wall or the interior surface of the baffle plate is slotted and grooved, and the slots and grooves on the surface of one member cooperate with the adjacent surface of the other member to define the cooling channels. In the embodiment described in the two preceding sentences, the exterior surface of the baffle plate constitutes another surface of the casting apparatus. In the embodiments illustrated in FIGS. 2, 3–4, 5, and 9, the exterior surface of mold wall 130 or 40 constitutes another surface of the casting apparatus. In all these embodiments, the aforementioned other surface of the casting apparatus is located outwardly of the cooling channels (e.g., 131 in FIG. 2 and 41 in FIGS. 3-4, 6, and 9). Similarly, in all of these embodiments, the casting comprises, at a plurality of locations between the upstream and downstream ends of the mold, solid structure extending continuously from the mold exterior surface (e.g., H in FIG. 6) to the aforementioned other surface of the apparatus.

A continuous casting mold having either vertical or horizontal cooling channels typically has tapered side walls which converge from the upstream end to the downstream end, and this tapered configuration, for a mold with horizontal cooling channels, is shown in dash-dot lines at 137 in FIG. 9. A continuous casting mold 37 with horizontal cooling channels 41 may be constructed so that each cooling channel 41 has it own entry 45 and its own exit 46, as shown in FIG. 3 and 4. In such a case, the rate at which cooling fluid is circulated through the various horizontal cooling channels can be adjusted for each cooling channel, and the respective mold wall temperature near each horizontal cooling channel can be controlled in such a manner that the tapered configuration, shown at 137 in FIG. 9, can be substantially eliminated, and the casting mold can have essentially vertical side walls as shown in full lines in FIG. 9.

Figure 8:
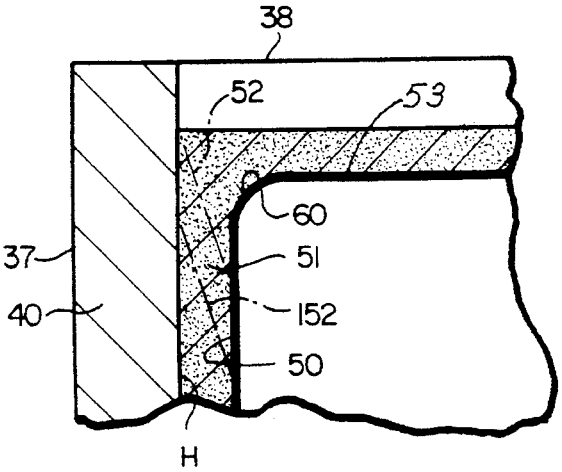
FIG. 8 is an enlarged, fragmentary, vertical sectional view of a conventional continuous casting mold containing molten steel undergoing solidification and employing a powdered mold lubricant.

Referring to FIG. 8, a continuous casting operation usually employs a lubricant, shown exaggeratedly at 51. In FIG. 8, lubricant 51 is shown as covering the top surface 53 of the molten steel in the mold, the molten steel meniscus 60, and the area between the interior surface H of a mold wall 40 and the exterior surface 50 of a steel shell undergoing solidification within the mold. The mold lubricant may be one which is liquid at ambient temperature, and this type of lubricant is applied to mold interior surface H at the beginning of and during the casting operation. Another type of mold lubricant is in the form of a powder which melts to form a liquid at the temperature of the molten steel within the casting mold; and this type of mold lubricant can be introduced into the mold during the casting operation.

When mold wall 37 is composed of copper, the temperature at interior surface H is relatively low, so that the powdered lubricant between interior surface H and exterior surface 50 of the solidified steel shell would not be in liquid form. Although the lubricant atop the molten steel within the mold may be liquid, the lubricant adjacent the interior surface H of the mold would be in solid form, separated from the liquid lubricant by a dividing line indicated in dash-dot lines at 52 in FIG. 8.

However, when mold wall 37 is composed of stainless steel, the temperature at interior surface H of mold wall 37 is substantially higher than when the mold wall is composed of copper; and in such a case, lubricant applied in powdered form would be liquid between mold interior surface H and steel shell exterior surface 50 at least in the upper portions of the mold, and the dividing line between liquid and solid lubricant would be much lower in the mold than when mold wall 37 is composed of copper. For example, from a representational point of view, if the dividing line is at 52 when the mold is made of copper, the dividing line could be at 152 when the mold is made of stainless steel. In other words, the distance below meniscus 60 at which there will be liquid lubricant will be greater with a stainless steel mold than with a copper mold.

Some powdered mold lubricants undergo recrystallization at an elevated temperature, and this property is desirable in some instances because a lubricant that recrystallizes can control heat transfer between the steel undergoing solidification and the mold side wall in a manner which reduces cracking in steels, such as peritectic steels, which are prone to cracking. When one employs a stainless steel casting mold, one can maintain an elevated temperature at mold wall interior surface H which will allow a powdered mold lubricant to recrystallize; whereas when the mold wall is composed of copper, a smaller fraction of the powdered mold lubricant will undergo recrystallization, in the space between mold wall interior surface H and steel shell exterior surface 50. Powdered mold lubricants with relatively high recrystallization temperatures and which could not be used with a mold composed of copper, can be used with a mold composed of stainless steel.

The casting temperatures employed in a continuous casting mold may vary with the composition of the steel undergoing casting. A stainless steel casting mold enables a casting operator to employ a variety of powdered mold lubricants not employable with a copper casting mold, and to select that particular powdered mold lubricant which best suits the steel composition undergoing casting, from the standpoint of certain lubricant properties such as a particular melting point or recrystallization temperature, as the case may be.

As noted above, in conventional continuous casting of steel the mold heat transfer rate (MHTR) for a stainless steel mold is somewhere between 70% and 90% of the MHTR for a copper mold, depending upon the casting speed and whether a liquid or powdered lubricant is employed. When molten steel is introduced into a mold, the molten steel forms a reverse meniscus adjacent the interior surface of the mold at the top of the molten steel. This is shown at 60 in FIG. 8.

The lower MHTR obtained with the stainless steel mold is due primarily to a lower MHTR near the meniscus, compared to the MHTR near the meniscus in a copper mold. This was reflected, for example, in a continuous casting operation employing molten steel containing 0.25 wt. % carbon, a casting speed of 1.1 m/min. in a mold that was about 46 cm long from upstream end to downstream end and had a square interior cross-section of 8.3 cm on each side. The mold lubricant was liquid, and the molten steel top surface was about 6.2 cm from the top of the mold. MHTRs were measured to a distance of about 40 cm from the top of the mold, and the following MHTR conditions were noted. Under circumstances where the overall MHTR for a stainless steel mold is about 75–80% of the overall MHTR for a copper mold, the MHTR for the stainless steel mold near the meniscus is only 65% of the MHTR near the meniscus for a copper mold; while at distances from the top of the mold of about 20 cm or more, the MHTR for the stainless steel mold is the same as or slightly higher than the MHTR for the copper mold. At casting speeds lower than 1.1 m/min. and with a powdered mold lubricant, the MHTR for the stainless steel mold would still be substantially lower than the MHTR for the copper mold near the meniscus; but at locations in the mold remote from the meniscus, the differences in MHTR would be drastically reduced, or the MHTR for the stainless steel mold could be higher in some instances, to provide an overall MHTR for the stainless steel mold which closely approximated that for the copper mold.

A lower MHTR near the meniscus is desirable because it improves the surface quality on the casting which exits from the casting mold. Because the stainless steel mold produces a lower MHTR near the meniscus than does the copper mold, the surface quality of the steel casting produced by the stainless steel mold should be better than the surface quality of the steel casting produced by a copper mold. Improved surface quality is also due to a decrease in the chilling effect on the solidifying steel surface at and near the meniscus as a result of the higher mold interior surface temperature for the stainless steel mold. Because there is a higher mold interior surface temperature there is a smaller difference between the temperature of the steel shell and the temperature of the mold interior surface; hence the decrease in chilling effect.

Continuous casting molds are conventionally oscillated in upstream and downstream directions to facilitate the movement of the steel shell through the mold. Oscillation can cause surface defects known as oscillation marks which are undesirable. Oscillation marks are less severe on steel castings made in stainless steel casting molds compared to steel castings made in copper casting molds. This is attributable to the fact that the interior surface H of the stainless steel mold is hotter than the interior surface of a copper mold.

Another advantage of a stainless steel mold over a copper mold is that there is less friction between the mold interior surface and the steel casting in a stainless steel mold than in a copper mold. In addition, the stainless steel mold has a higher hardness than the copper mold. These two factors, reduced friction and increased hardness for the stainless steel mold, should substantially reduce mold wear, when the mold is composed of stainless steel rather than copper, thereby substantially increasing the life of the mold. Reduced friction levels within the mold also reduces the likelihood of the solidifying shell sticking within the mold which in turn reduces the likelihood of molten metal breaking out through the solidified steel shell as the shell exits the mold. A decrease in friction also improves the surface quality of the solidified steel casting.

A continuous casting mold is frequently associated with an electromagnetic stirring coil or other electromagnetic device located around the continuous casting mold, and this is so whether the continuous casting mold is employed in a conventional continuous casting apparatus or in a rheocasting apparatus. Other such magnetic devices associated with a mold include magnetic brakes or magnetic devices for dampening waves in the molten metal. The following exemplary discussion relates to magnetic stirring devices, unless otherwise indicated.

When the mold is composed of copper, there is a substantial attenuation of the strength of the magnetic field produced by the magnetic stirring coil. Approximately 50% of the strength of the magnetic field is attenuated due to the high electrical conductivity of copper. When the continuous casting mold is composed of stainless steel, however, there is a substantial reduction in attenuation of the strength of the magnetic field. The less the attenuation of the magnetic field, the greater the stirring intensity, due to the magnetic field, in the molten steel within the casting mold.

In addition to substantially reducing attenuation of the strength of the magnetic field, a stainless steel casting mold allows one to operate a magnetic stirrer at a frequency greater than 40 Hertz (e.g. 400–600 Hertz) which is substantially higher than the frequency (4–20 Hertz) which could be employed if the mold were composed of copper. In many instances the magnetic stirrer frequency thus employed can be equal to (or greater than) the local main line power transmission frequency which is, for example, 60 Hertz in the U.S.A. and 50 Hertz in Europe.

An increase in the operating frequency of the magnetic stirrer produces an increase in stirring frequency within the molten steel and enhances the stirring undergone by the molten steel within the mold. All other conditions being equal, the use of a stainless steel casting mold instead of a copper casting mold can increase stirring intensity or velocity by about 100%.

Figure 10:
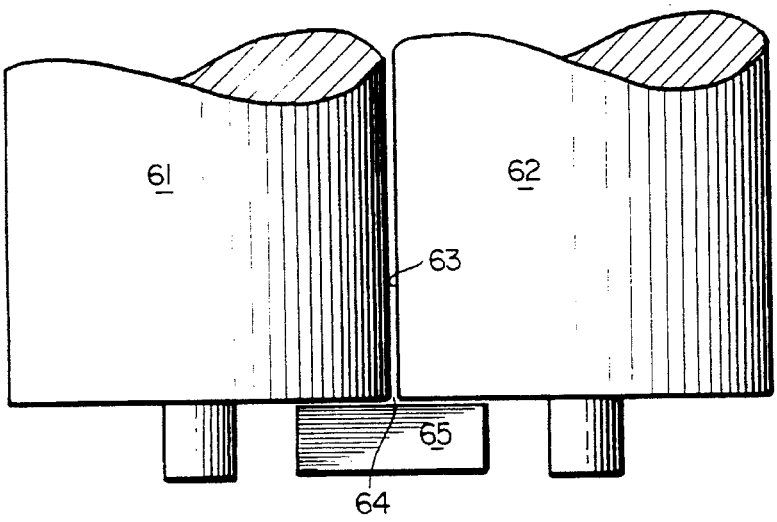
FIG. 10 is a fragmentary plan view of a double substrate continuous strip casting apparatus.
Figure 11:
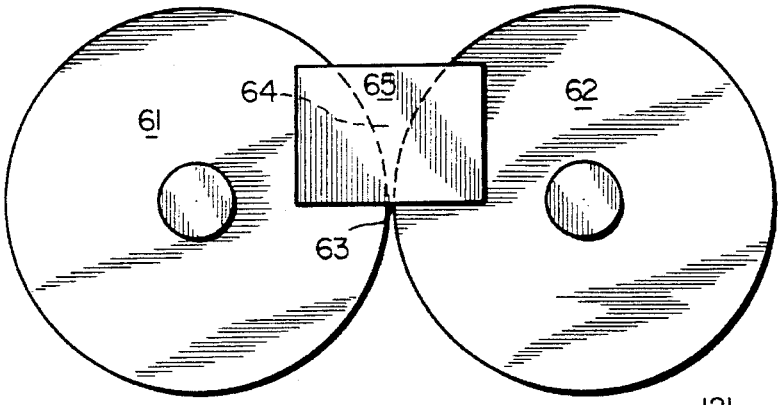
FIG. 11 is an end view of the continuous strip casting apparatus of FIG. 10.
Figure 12:
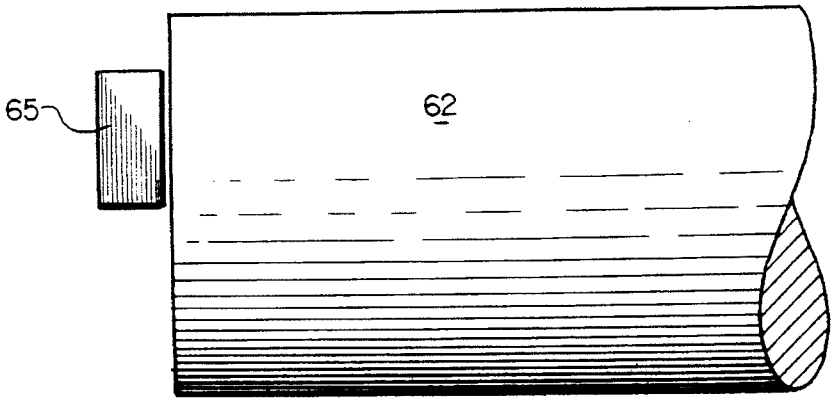
FIG. 12 is a fragmentary side view of the continuous strip casting apparatus of FIG. 10.

Referring now to FIGS. 10–12, illustrated therein is a double substrate continuous strip casting apparatus comprising a pair of counter-rotating rolls 61, 62. Rolls 61, 62 are cooled by a cooling fluid circulated through cooling channels (not shown). Molten steel is introduced between rolls 61, 62 and undergoes cooling as the molten steel descends through the gap at the nip 63 between the rolls thereby producing a solid continuous strip of steel below nip 63. There is a side opening 64 at each opposite end of the pair of rolls 61, 62. Absent some restraint, molten metal would flow outwardly through each side opening 64. To prevent this from occurring, a continuous strip casting apparatus may include a magnetic containment dam illustrated diagrammatically at 65. There is a magnetic containment dam 65 at each side opening 64, and each magnetic containment dam generates a magnetic field for preventing the molten steel from flowing outwardly through side opening 64. Detailed descriptions of various magnetic containment dams and their manner of operation are disclosed in the aforementioned Praeg patent and Lari, et al. patent and in the aforementioned Gerber, et al. application. The disclosures thereof are incorporated herein by reference.

Figure 13:
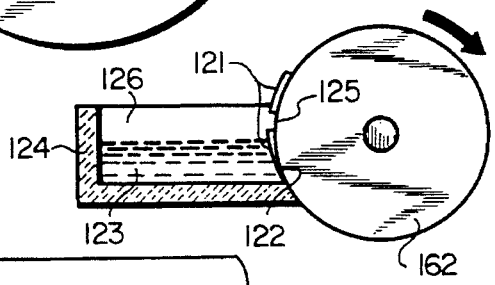
FIG. 13 is an end view of a single substrate continuous casting apparatus.

FIG. 13 illustrates a single substrate continuous strip casting apparatus comprising a three-sided tundish 124 typically containing a bath 123 of molten steel. Tundish 124 has sidewalls (e.g. 126) on three sides and is open on the fourth side, at 122. A rotating roll 162 is located at and substantially closes open side 122 of the tundish. Roll 162 rotates in a clockwise sense, as viewed in FIG. 13, and upwardly at tundish open side 122. Roll 162 is cooled and molten metal solidifies as a strip 121 on the exterior of roll 162 as the roll rotates upwardly alongside molten metal bath 123. The solidified strip 11 increases in thickness from the bottom to the top of bath 123. Strip 121 is separated from casting roll 162 in a conventional manner, and a continuous strip is withdrawn from the casting roll as the roll continues to rotate.

The junction of tundish open side 122 and roll 162 is at the ends 125 of sidewalls 126. This junction is physically unsealed, and to prevent molten metal from leaking outwardly from the tundish at the unsealed junction, one may provide a magnetic containment dam there at each end of roll 162. Although not shown in FIG. 13, the dam could be similar to 65 in FIGS. 10–12.

Rolls 61, 62 (FIGS. 10–12) define the casting mold for the double substrate continuous strip casting apparatus; and roll 162 defines the counterpart of the continuous mold in the single substrate continuous strip caster of FIG. 13. As noted above, each roll 61, 62 and 162 has a surface for contacting and solidifying the molten steel. Each such surface extends substantially continuously between opposite ends of the roll (FIGS. 10–12), and each such surface is composed of a non-magnetic material that, at the roll ends, serves to minimize the attenuation of the magnetic field generated by the magnetic containment dam. Generally, a strip casting speed in the range 1–50 m/min. may be used in continuous strip casting employing rolls constructed in accordance with the present invention.

Rolls 61, 62 and 162 may be composed of the same austenitic stainless steel as the casting molds for the conventional continuous casting apparatus or the rheocasting apparatus. Examples of austenitic stainless steels which may be employed for such purposes include 302, 304 and 316 stainless steels. These stainless steels have the respective compositions set forth in the following tabulation, expressed in weight percent.

| Element | 302 | 304 | 316 |
|---|---|---|---|
| C | 0.15 | 0.08 max. | 0.08 max. |
| Mn | 2.00 max. | 2.00 max. | 2.00 max. |
| Si | 1.00 max | 1.00 max. | 1.00 max. |
| Cr | 17–19 | 18–20 | 16–18 |
| Ni | 8–10 | 8–12 | 10–14 |
| P | 0.045 max. | 0.045 max. | 0.045 max. |
| S | 0.030 max. | 0.030 max. | 0.030 max. |
| Mo | — | — | 2–3 |

In all three stainless steels, the balance consists essentially of iron.

Other equivalent materials may be employed so long as they have the desired combination of characteristics; these are: non-magnetic; a relatively high electrical resistance compared to copper; and a thermal conductivity substantially lower than copper. Materials which possess these characteristics include the silicon bronzes (C 65100 and C 65500) and boron nitride.

Additional desirable properties include one or more of the following: a melting point which is, at a minimum, not substantially lower than that of copper; a thermal expansion coefficient no greater than that of copper; and a relatively high resistance to thermal stress compared to copper or to conventional non-metallic refractory material.

With respect to the two silicon bronzes, they have respective compositions as tabulated below, in wt. %.

| Element | C 65100 | C 65500 |
|---|---|---|
| Si | 0.8.–2.0 | 2.8–3.8 |
| P | 0.05 max. | 0.5 max. |
| Fe | 0.8 max. | 0.8 max. |
| Zn | 1.5 max. | 1.5 max. |
| Mn | 0.7 max. | 1.5 max. |
| Ni | — | 0.6 max. |

In both composition, the balance consists essentially of copper.

The foregoing discussion was in the context of a continuous casting apparatus which employs a mold in accordance with the present invention at least in part because the mold material minimizes attenuation of a magnetic field when the mold is associated with an electromagnetic stirrer or other electromagnetic device. The mold of the present invention may also be employed in continuous casting apparatuses where the mold is not associated with an electromagnetic device.

In such a case, other desirable properties of the mold material are advantageously utilized, including at least some of the following: reduced friction and increased hardness compared to copper; reduced likelihood of sticking and breakouts in the mold, compared to copper; increased resistance to thermal stress compared to copper; increased usefulness with a variety of mold lubricants, liquid and powdered; reduced thermal expansion compared to copper; and reduced thermal and electrical conductivity compared to copper.

The foregoing detailed description has been given for clearness of understanding only, and no unnecessary limitations should be understood therefrom as modifications will be obvious to those skilled in the art.

What is claimed is:

1. In combination:

a continuous casting mold comprising an open upstream end for receiving molten steel flowing in a downstream direction, and an open downstream end through which at least partially solidified steel exits from said mold;

and an electromagnetic device associated with said mold for directing a magnetic field into the molten steel contained within said mold;

said mold being composed of a non-magnetic material which, compared to copper, has the following relative properties: (a) a melting point which, at a minimum, is not substantially lower than the melting point of copper, (b) lower thermal and electrical conductivity, and (c) lower resistance to penetration by a magnetic field;

said mold comprising means, including said mold material, for extracting heat from said molten steel at a rate approaching that of a mold composed of copper;

said mold comprising means, including said mold material, for substantially reducing the attenuation of the magnetic field generated by said electromagnetic device, compared to the attenuation caused by a mold composed of copper;

said mold having a pair of opposed side ends;

said mold having a surface for contacting said molten steel;

said surface being composed of said mold material and having the same thermal properties from said upstream mold end to said downstream mold end and from one side end of the mold to the other side end.

2. A combination as recited in claim 1 wherein:

said mold material is composed of austenitic stainless steel.

3. A combination as recited in either of claims 1 or 2 wherein:

said mold comprises at least one continuous casting roll.

4. A combination as recited in either of claims 1 or 2 wherein:

said mold is a conventional continuous casting mold.

* * * * *

UNITED STATES PATENT AND TRADEMARK OFFICE

CERTIFICATE OF CORRECTION

PATENT NO. : 5,494,095

DATED : February 27, 1996

INVENTOR(S) : KENNETH E. BLAZEK, ISMAEL G. SAUCEDO and JAMES E. KELLY

It is certified that error appears in the above-identified patent and that said Letters Patent is hereby corrected as shown below:

Col. 3, line 48, "ms" should be --is--.

Col. 4, line 59, "$\neq T_{ss}$" should be --$\Delta T_{ss}$--.

Col. 5, line 7, "(ΔAT/ΔX)" should be --(ΔT/AX)--.

Col. 5, line 7-8 "k(ΔT/ΔAX)" should be --k(ΔT/ΔX)--.

Signed and Sealed this

Eleventh Day of June, 1996

Bruce Lehman

*Attest:*

BRUCE LEHMAN

*Attesting Officer*

*Commissioner of Patents and Trademarks*